US007997167B2

(12) United States Patent
Kruse et al.

(10) Patent No.: US 7,997,167 B2
(45) Date of Patent: Aug. 16, 2011

(54) CLAMPING AND BREAKING DEVICE

(75) Inventors: Christof Kruse, Wenden (DE); Stefan Wrede, Kirchhundem (DE)

(73) Assignee: Longyear TM, Inc., South Jordan, UT (US)

( * ) Notice: Subject to any disclaimer, the term of this patent is extended or adjusted under 35 U.S.C. 154(b) by 56 days.

(21) Appl. No.: 12/197,817

(22) Filed: Aug. 25, 2008

(65) Prior Publication Data

US 2009/0056931 A1 Mar. 5, 2009

Related U.S. Application Data

(60) Provisional application No. 60/968,970, filed on Aug. 30, 2007.

(51) Int. Cl.
*B25B 13/50* (2006.01)
*B25B 17/00* (2006.01)

(52) U.S. Cl. ..... 81/57.34; 81/57.21; 81/57.19

(58) Field of Classification Search ..... 81/57.16, 81/57.21, 57.19, 57.34, 57.18, 57.2, 57.36
See application file for complete search history.

(56) References Cited

U.S. PATENT DOCUMENTS

| | | | | |
|---|---|---|---|---|
| 430,994 | A | | 6/1890 | Ely |
| 621,293 | A | | 3/1899 | Crass |
| 712,253 | A | | 10/1902 | Brwon et al. |
| 1,416,685 | A | | 5/1922 | Bufford |
| 2,633,045 | A | * | 3/1953 | Lurie ..... 81/179 |
| 2,650,070 | A | | 8/1953 | Lundeen |
| 2,921,489 | A | | 1/1960 | Schweitzer |
| 2,928,301 | A | | 3/1960 | Beeman |
| 2,933,961 | A | | 4/1960 | Adams |
| 2,989,880 | A | | 6/1961 | Hesser et al. |
| 3,880,024 | A | | 4/1975 | Asada |
| 3,892,140 | A | | 7/1975 | Fox et al. |
| 4,079,640 | A | | 3/1978 | Golden |
| 4,212,212 | A | | 7/1980 | Chandler et al. |
| 4,221,269 | A | | 9/1980 | Hudson |
| 4,324,157 | A | | 4/1982 | Soutsos |
| 4,485,697 | A | | 12/1984 | Heilhecker et al. |
| 4,512,216 | A | | 4/1985 | Callegari, Sr. et al. |
| 4,604,922 | A | | 8/1986 | Soutsos |
| 4,683,962 | A | | 8/1987 | True |
| 4,694,712 | A | | 9/1987 | Doss |

(Continued)

FOREIGN PATENT DOCUMENTS

AU 2008296490 2/2001

(Continued)

OTHER PUBLICATIONS

U.S. Appl. No. 61/052,577, filed May 12, 2008, Trevor Lyndon Light.

(Continued)

*Primary Examiner* — Hadi Shakeri
(74) *Attorney, Agent, or Firm* — Workman Nydegger

(57) ABSTRACT

A system for clamping and breaking threaded tubular members includes a clamping device configured to grip a threaded tubular member. The clamping device further includes a housing and a base mount associated with the housing. A breaking device can be provided to grip and rotate a threaded tubular member, the breaking device further including a housing and a base mount associated with the housing in which the base mount of clamping device and the base mount of the breaking device are configured to be mounted independently to at least one support structure.

20 Claims, 8 Drawing Sheets

U.S. PATENT DOCUMENTS

| | | | | | |
|---|---|---|---|---|---|
| 4,765,401 | A | | 8/1988 | Boyadjieff | |
| 4,843,924 | A | | 7/1989 | Hauk | |
| 4,885,963 | A | | 12/1989 | Nishikawa | |
| 4,895,056 | A | | 1/1990 | Schulze-Beckinghausen | |
| 5,054,550 | A | | 10/1991 | Hodge | |
| 5,060,542 | A | * | 10/1991 | Hauk | 81/57.34 |
| 5,092,411 | A | | 3/1992 | Hausherr et al. | |
| 5,207,128 | A | * | 5/1993 | Albright | 81/57.21 |
| 5,320,021 | A | | 6/1994 | Heintz | |
| 5,435,213 | A | | 7/1995 | Buck | |
| 5,660,087 | A | | 8/1997 | Rae | |
| 5,845,549 | A | * | 12/1998 | Bouligny | 81/57.34 |
| 5,868,045 | A | * | 2/1999 | Hauk | 81/57.34 |
| 5,931,231 | A | | 8/1999 | Mock | |
| 6,050,156 | A | | 4/2000 | Buck | |
| 6,070,500 | A | * | 6/2000 | Dlask et al. | 81/57.18 |
| 6,082,225 | A | | 7/2000 | Richardson | |
| 6,318,199 | B1 | | 11/2001 | Buck | |
| 6,634,443 | B1 | | 10/2003 | Paech et al. | |
| 6,910,402 | B2 | | 6/2005 | Drzewiecki | |
| 6,971,283 | B2 | * | 12/2005 | Belik | 81/57.33 |
| 7,000,502 | B2 | | 2/2006 | Belik | |
| 7,117,938 | B2 | | 10/2006 | Hamilton et al. | |
| 7,188,547 | B1 | | 3/2007 | West et al. | |
| 7,191,686 | B1 | | 3/2007 | Angelle et al. | |
| 2002/0157823 | A1 | | 10/2002 | Pietras et al. | |
| 2003/0177870 | A1 | | 9/2003 | Neves et al. | |
| 2003/0221871 | A1 | | 12/2003 | Hamilton | |
| 2005/0072274 | A1 | | 4/2005 | Hauk et al. | |
| 2006/0053977 | A1 | | 3/2006 | Hawkins, III | |
| 2006/0054331 | A1 | | 3/2006 | Hawkins, III | |
| 2006/0179980 | A1 | | 8/2006 | Pietras et al. | |
| 2006/0243490 | A1 | | 11/2006 | Riel | |
| 2007/0017703 | A1 | | 1/2007 | Belik | |
| 2010/0083796 | A1 | | 4/2010 | Nelson | |

FOREIGN PATENT DOCUMENTS

| | | |
|---|---|---|
| DE | 29720465 | 1/1998 |
| DE | 20202396 | 6/2002 |
| EP | 1644608 | 11/2007 |
| JP | 62-156468 | 10/1987 |
| JP | 07-062968 | 3/1995 |
| JP | 09-250285 | 9/1997 |
| JP | 2652808 | 9/1997 |
| JP | 2002-194984 | 7/2002 |
| JP | 2003-184471 | 7/2003 |
| WO | WO98/26153 | 6/1998 |
| WO | WO99/06186 | 2/1999 |
| WO | WO99/55728 | 11/1999 |
| WO | WO03/033858 | 4/2003 |
| WO | PCT/US2008/067007 | 12/2008 |
| WO | PCT/US2009/043628 | 10/2009 |
| WO | PCT/US2009/043633 | 12/2009 |
| WO | PCT/US2008/074499 | 3/2010 |

OTHER PUBLICATIONS

U.S. Appl. No. 12/119,385, filed Jun. 12, 2008, Keith William Littlely.
U.S. Appl. No. 12/138,297, filed Jun. 12, 2008, Lauzon et al.
www.scorpion.com Scorpion Oil Tools 400 series.
U.S. Appl. No. 12/138,297, mail date Jan. 25, 2010, Restriction Requirement.
U.S. Appl. No. 12/119,385, mail date Mar. 3, 2010, Office Action.
U.S. Appl. No. 12/138,297, mail date May 27, 2010, Office Action.
Issue Notification dated Nov. 23, 2010 from U.S. Appl. No. 12/119,385, filed May 12, 2008 (1 page).
International Search Report dated Dec. 23, 2008 from PCT/US2008/067007 (4 pages).
Written Opinion dated Dec. 23, 2008 from PCT/US2008/067007 (6 pages).
Written Opinion dated Dec. 1, 2009 from PCT/US2009/043633 (3 pages).
Written Opinion dated Oct. 28, 2009 from PCT/US2009/043628 (5 pages).
International Search Report dated Jan. 21, 2009 from PCT/US2008/074499 (3 pages).
Written Opinion dated Jan. 21, 2009 from PCT/US2008/074499 (4 pages).
Notice of Allowance dated Sep. 24, 2010 from U.S. Appl. No. 12/119,385, filed May 12, 2008 (8 pages).
Office Action dated Nov. 9, 2010 from U.S. Appl. No. 12/138,297, filed Jun. 12, 2008 (11 pages).
Office Action dated Jan. 27, 2011 from Australian Patent Application No. 2008265945 filed Jun. 13, 2008 (2 pages).
Notice of Allowance dated Jan. 28, 2011 from U.S. Appl. No. 12/138,297 filed Jun. 12, 2008 (15 pages).
Office Action dated Jan. 31, 2011 from U.S. Appl. No. 12/464,707 filed May 12, 2009 (13 pages).
Notice of Allowance dated Apr. 15, 2011 from U.S. Appl. No. 12/138,297 filed Jun. 12, 2008 (8 pages).
Notice of Allowance dated May 19, 2011, 2011 from U.S. Appl. No. 12/464,707 filed May 12, 2009 (16 paegs).

* cited by examiner

CLAMPING AND BREAKING DEVICE

RELATED APPLICATIONS

The present application claims the benefit of U.S. Provisional Patent Application Ser. No. 60/968,970 filed Aug. 30, 2007, which is hereby incorporated by reference in its entirety.

BACKGROUND OF THE INVENTION

1. The Field of the Invention

The present invention relates to equipment for manipulating threaded tubular members and to clamping threaded tubular members and breaking joints between threaded tubular members.

2. The Relevant Technology

The process of drilling, especially in subterranean formations, often involves lifting numerous drill rods into place and then connecting them together. The connected drill rods form a drill string, which is often tipped with a drill bit. The connection between adjacent drill rods is often referred to as a joint. Frequently, the joints between the drill rods are formed when one drill rod with male threads is threaded into engagement with female threads of another drill rod. The joint between the drill rods is often tightened to maximum torque using a clamping and breaking device. During the drilling process, a drill rig applies an axial force and rotates the drill string, often causing these joints to become very tight and possibly require tremendous force to break the joint and separate the drill rods.

When the drill string is removed from the borehole (the hole created during drilling), the entire string of drill rods may need to be removed by tripping the drill string out of the borehole. As this is done, each of the joints for the rods, which now may be extremely tight, are often broken by unthreading the male and female ends of adjacent drill rods. In some instances, multiple drill rods (which are typically around 5, 10, or 20 feet), may be connected to form a string that extends for very long distances. Thus, a single drill string may have hundreds of joints that may need to be broken and separated. The drill rods are often tightened to a torque higher than the torque applied by a drill head. Accordingly, the torque in the joint can be similarly high.

Conventionally, several methods and associated devices have been used to break the connections between the threaded ends of adjacent drill rods. Most of these proposed methods and devices typically employ some form of power-equipped wrench or similar tool to provide the torque necessary to break the threaded connections between drill rods. Typically, two drill rods are threaded (or unthreaded) by holding one drill rod stationary with one of the jaws while the rotating the other drill rod in the appropriate direction using the other jaw.

While such configurations can provide for the breaking of joints, difficulties can still arise from time to time. For example, many tools only provide a fixed or narrow range of gripping diameters, so that the jaws or the entire device must be changed when moving from one diameter to another. Further, some tools provide a fixed axial distance between the jaw sets such that longer or shorter threaded connections cannot be accommodated. In addition, many tools do not provide sufficient frictional contact between the contact surface on the tong dies and the drill rod, causing the drill rods to slip when being threaded or unthreaded and leading to inefficiencies as well as safety hazards. This problem can be exacerbated as the tong dies wear over time. And the slipping itself can even contribute to the wear on the tong dies. Additionally, many current tools are manufactured with tong dies that must be replaced often, resulting in inefficiencies when the drilling operation is halted while the tong dies are replaced.

Another potential difficulty can arise when the tong dies are replaced. For example, in many systems the tong dies can only be replaced when the whole drill string has been removed out of the bore hole. Otherwise, there is not enough room to exchange the tong dies. The resulting risk is that the entire drill string can slip out of the jaws and fall back into the borehole.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

In at least one example, a jaw assembly includes a jaw body having a first end and a second end and at least one insert pocket defined in the jaw body. The insert pocket includes an arcuate profile relative to a plane between the first end and the second end and an opening in communication with the second end. A shoulder formed is on the first end of the jaw body. The jaw body is in communication with the opening. The jaw assembly further includes at least one insert having an at least partially arcuate shape complimentary to the insert pocket in which the insert is configured to rotate within the pocket and wherein the shoulder is configured to retain the insert in the pocket relative to the second end.

A system for clamping and breaking threaded tubular members can also be provided that includes a clamping device configured to grip a threaded tubular member. The clamping device further includes a housing and a base mount associated with the housing. A breaking device can be provided to grip and rotate a threaded tubular member, the breaking device further including a housing and a base mount associated with the housing in which the base mount of clamping device and the base mount of the breaking device are configured to be mounted independently to at least one support structure.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The following description supplies specific details in order to provide a thorough understanding. Nevertheless, the skilled artisan would understand that the apparatus and associated method of assembly and use can be implemented and used without employing theses specific details. Indeed, the apparatus and associated method of use can be placed into practice by modifying the apparatus and associated method and can be used in conjunction with any apparatus, systems, components, and/or techniques conventionally used in the industry. For example, while the description below focuses on using these with drill rigs normally employed in foundation and exploration drilling, they could be adapted to be used with drill rigs employed in the oil and gas industries or to any other application in which joints between threaded tubular members are broken.

The devices for assembling and disassembling tubular members contain a set of jaws for gripping or clamping the ends of two adjacent drill rods and then rotating one drill rod relative to the other. In the embodiments described below, the set of jaws contains two jaws, one located on each of two adjacent drill rods. In other embodiments, though, additional jaws could be included. For example, there could be one jaw for gripping a first drill rod and multiple jaws for the other drill rod, or vice versa. In another example, there could be multiple jaws for each drill rod.

To loosen two threaded drill rods, the joint of the threaded connection is positioned between a clamping device containing a fixed jaw and a breaking device containing a rotatable jaw. The fixed jaw clamps the lower drill rod, which can still remain partially inside the ground. The rotatable jaw clamps the upper drill rod, i.e., the drill rod above the ground and often on the drill mast of a drill rig. Then, the rotatable jaw turns the upper rod enough to break the threaded connection.

Figure 1A:
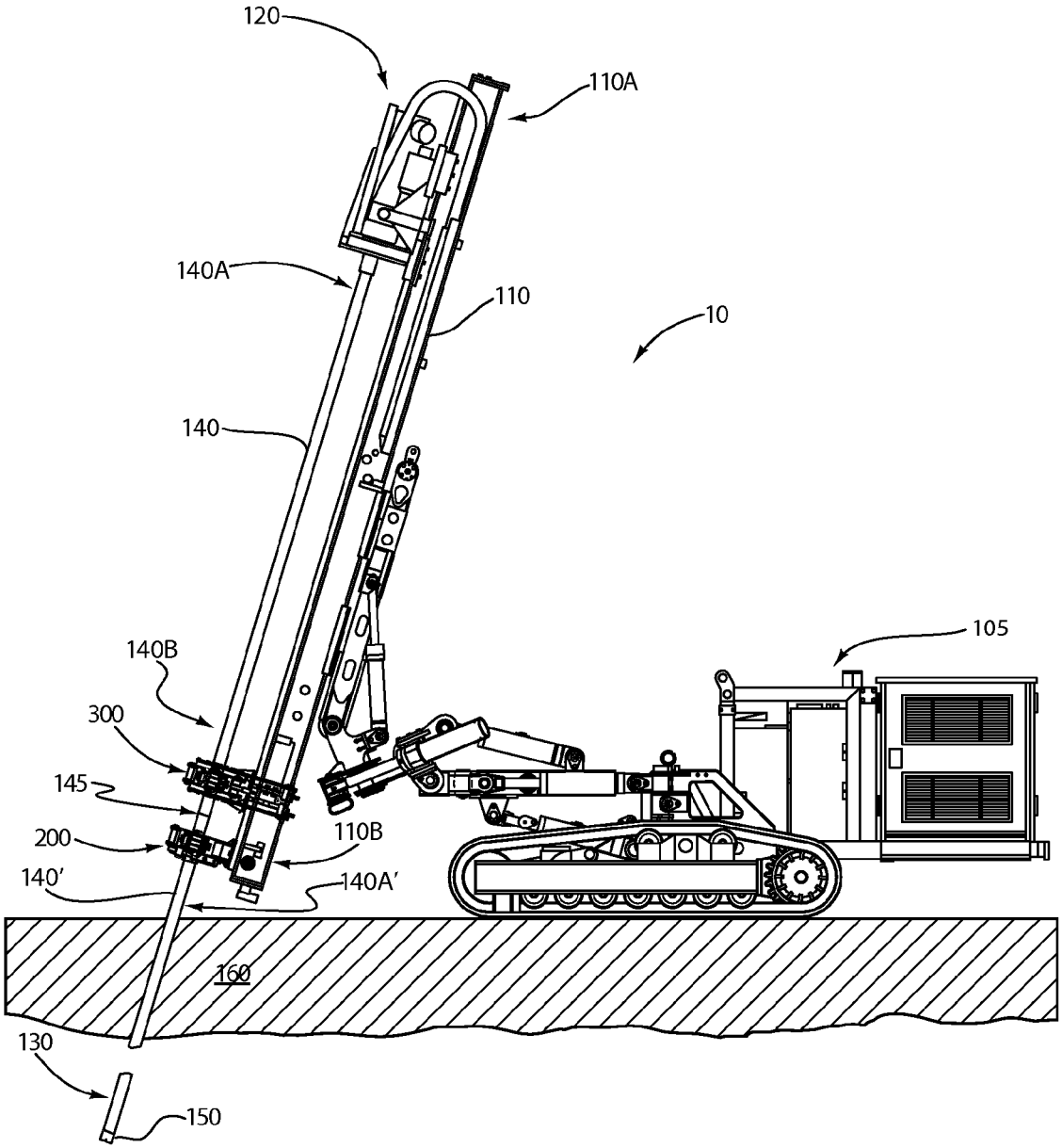
FIG. 1A illustrates a drilling system that includes a clamping and breaking system according to one example.

FIG. 1A illustrates a drilling system 10 that includes a clamping and breaking system 100 according to one example. The clamping and breaking system 100 generally includes a clamping device 200 and a breaking device 300. In the illustrated example, the drilling system 100 includes a rig 105. A mast 110 can be coupled to the rig 105. The mast 110 is configured to support a drill head 120. In particular, the mast 110 supports the drill head 120 as the drill head 120 translates between an upper end 110A and a lower end 110B of the mast 110. While the mast 110 is illustrated at a particular orientation, it will be appreciated that the mast 110 may be oriented at any angle as desired.

The drill head 120 is operatively associated with a drill string 130 that may include any number of drill rods 140. The drill head 120 includes mating features configured to engage corresponding mating features in a head or upper end 140A of the drill rod 140. In at least one example, the drill head 120 includes male features, such as external threads, while the head end 140A of the drill rod 140 includes female features, such as internal threads. Accordingly, the female features on the drill rod 140 may be rotated into engagement with the male features on the drill head 120.

Further, a bit end 140B of the drill rod 140 may include male features, such as external threads, that may be similarly coupled with additional drill rods to form the drill string 130. The junction between adjacent drill rods may be referred to as a joint 145. While upper ends (head ends) are described as having male features, such as internal threads, and the lower ends (bit ends) are described as having female features, such as internal threads, individual drill rods may be mated to other drill rods in any manner.

A drill bit 150 is operatively associated with a lower end of the drill string 130. The drill head 120 applies forces to the drill string 130, which are at least partially transmitted to the drill bit 150 to thereby cause the drill bit 150 to advance through a formation 160. The forces applied to the drill string 130 can include, without limitation, rotary, axial, percussive, and/or vibratory as well as any combination of forces.

For ease of reference, the following examples will be discussed in the context of a drill head that is configured to apply rotary and axial forces to the drill string 130 and thence the drill bit 150. In at least one example, the rotary forces may be described as rotation in a first direction, which may be a clockwise direction. For ease of reference, a second direction will also be described, which may be counter clockwise. These designations are arbitrary and the devices may be rotated as desired.

As introduced, the drilling system 10 includes machinery and/or devices for translating the drill head 120 relative to the mast 110. This translation includes advancing the drill head 120 as the drill bit 150 penetrates the formation 160. During a drilling operation, both the clamping device 200 as well as the breaking device 300 may be disengaged from the drill string 130 to allow the drill string 130 to move freely. The clamping device 200 can be used to clamp drill rod 140' to allow the breaking device 300 to rotate drill rod 140 to break the joint 145.

The clamping device 200 can be positioned at any desired location, such as near the lower end 110B of the mast 110. The breaking device 300 can be positioned independently of the clamping device 200. In at least one example, the breaking device 300 can be secured to the mast 110 at various locations to provide desired separation between the clamping device 200 and the breaking device 300

Figure 1B:
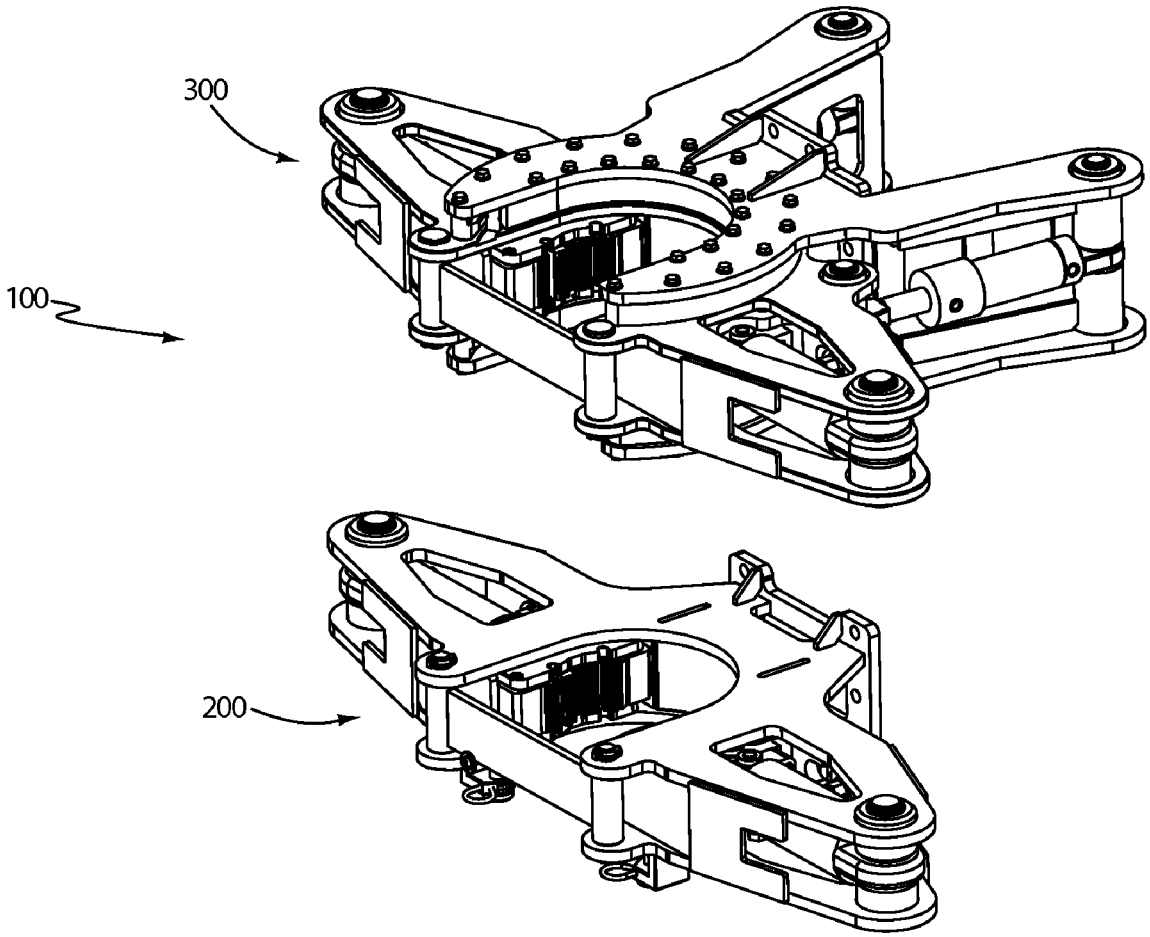
FIG. 1B illustrates an isolated perspective view of a clamping and breaking system according to one example.

FIG. 1B illustrates a perspective view of the clamping and breaking system 100. As introduced, the clamping and system 100 can be secured to a mast 110 (FIG. 1A). As illustrated in FIG. 1B, the clamping device 200 and the breaking device 300 can be moved and/or mounted separately and/or independently. Accordingly, the clamping device 200 and the breaking device 300 can each be positioned as desired to provide a desired amount of separation between the two. Further, in addition to a mast, the clamping device 200 and breaking device 300 can be coupled to other support structure or support structures. The support structure or structures can also include a part of any known drilling rig, as the mast 110 (FIG. 1). Of course, other fixed locations such as excavator attachments or even separate support structures, i.e., at long directional drillings at the pipe side of the bore hole could be used. An exemplary clamping device 200 will now be discussed, followed by a discussion of an exemplary breaking device 300.

Figure 2A:
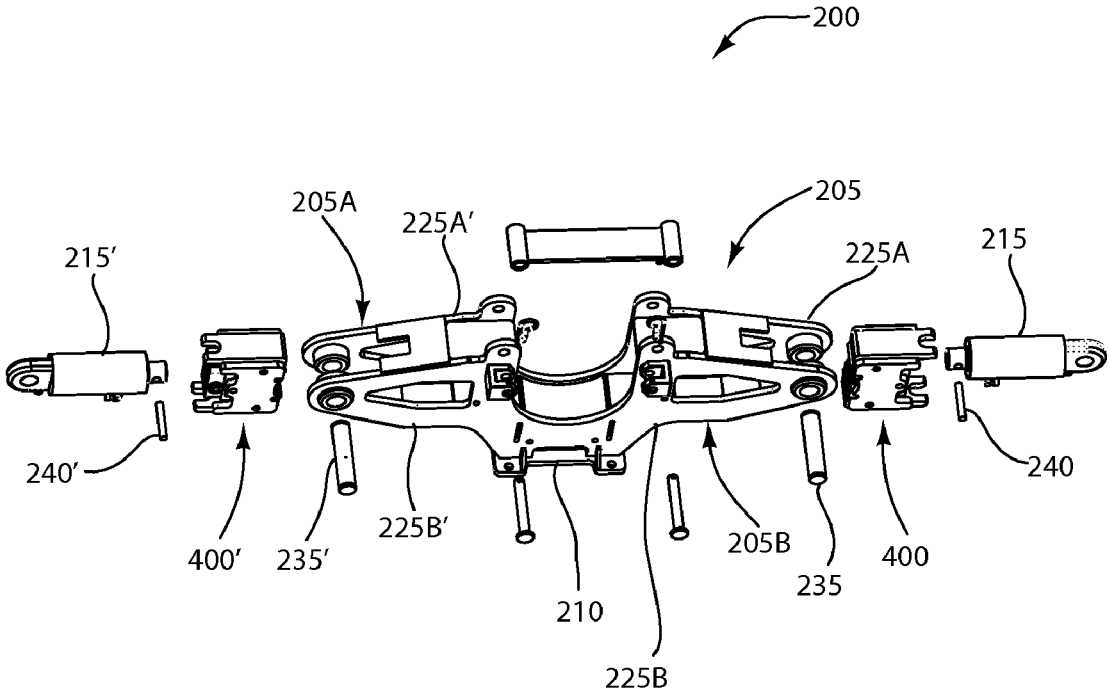
FIG. 2A illustrates an exploded view of a clamping device according to one example.

FIG. 2A illustrates an exploded view of a clamping device 200 according to one example. As illustrated in FIG. 2A, the clamping device 200 includes a housing 205 having an upper portion 205A and a lower portion 205B. The upper portion 205A and lower portion 205B are spaced apart by a base mount 210 as well as any number of additional peripheral supports. In addition to maintaining the upper portion 205A and the lower portion 205B spaced apart from each other, the base mount 210 can allow the clamping device 200 to be secured to a support structure at a desired location to thereby provide a stable platform from which the clamping device 200 can operate.

In at least one example, the upper portion 205A and the lower portion 205B can have substantially similar configurations. In other examples, the upper portion 205A and the lower portion 205B can have different configurations. For ease of reference, an example will be discussed in which the upper portion 205A and the lower portion 205B have substantially similar configurations. Accordingly, the discussion of the upper portion 205A can be applicable to the lower portion 205B.

Figure 2B:
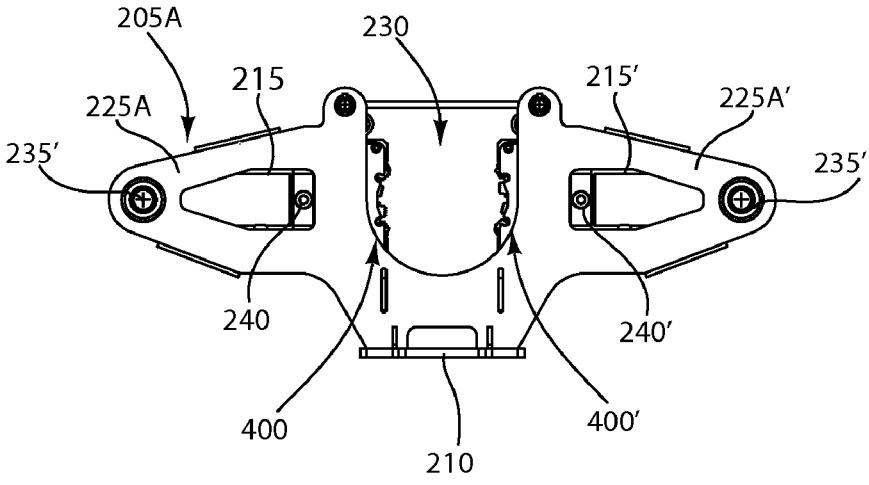
FIG. 2B illustrates a top view of an assembled clamping device according to one example.

The housing 205 is configured to support one or more of the components of the clamping device 200, including one or more linear actuators, such as clamping cylinders 215, 215'. The clamping cylinders 215, 215' are configured to position one or more jaw assemblies 400, 400'. In particular, as illustrated in FIG. 2B, the upper portion 205A generally includes opposing arms 225A, 225A'. An opening 230 is defined near a central portion of the housing 205 and passes through the upper portion 205A. The opening 230 can be sized to allow drill rods or other elongate threaded members of varying diameters to pass through the clamping device 200.

As illustrated in FIGS. 2A and 2B, the clamping cylinders 215, 215' are secured to the housing 205 by outer pins 235, 235'. In particular, the outer pins 235, 235' can pass through upper portion 205A, through the clamping cylinders 215, 215' and at least partially through the lower portion 205B. The outer pins 235, 235' can be secured in place in any suitable manner, such as by a nut, by threaded engagement with one or more of the upper or lower portions 205A, 205B, by lock/snap rings, some combination of these or in any other manner. Further, any number of fasteners can be used to secure any number of components described herein. Many of such fasteners have been omitted for clarity in describing the operation of the clamping and breaking system 10 (FIGS. 1A-1B).

The clamping cylinders 215, 215' can transfer forces to the jaw assemblies 400, 400' in any manner as they extend and retract. In particular, channels can be defined between the upper arms 225A, 225A' and lower arms 225B, 225B that are sized to receive and guide the jaw assemblies 400, 400' when the jaw assemblies 400, 400' are moved by extending and retracting the clamping cylinders 215, 215'. In the illustrated example, extension and retraction of the clamping cylinders 215, 215' moves the jaw assemblies 400, 400' into and out of the opening 230. In at least one example, the clamping cylinders 215, 215' can exert a force directly onto the jaw assemblies 400, 400' as they extend. Further, inner pins 240, 240' can secure the clamping cylinders 215, 215' to the jaw assemblies 400, 400' such that as the clamping cylinders 215, 215' retract, the clamping cylinders 215, 215' move the clamping cylinders 215, 215' relative to the housing 205. The clamping device 200 can further include a retention structure, such as a retention strap 242 that is configured to retain a threaded tubular member within the opening 230. In the illustrated example, the retention strap 242 can be removably coupled to the housing 204 with pins 244.

Moving the jaw assemblies 400, 400' toward and away from the opening 230 can allow the jaw assemblies 400 to engage drill rods or other elongate threaded members of varying diameters as well as to apply a sufficient force to the drill rod to clamp the drill rod. Clamping the drill rod can include applying sufficient force to reduce or eliminate rotation of the drill rod relative to the jaw assemblies 400, 400'. In at least one example, the jaw assemblies 400, 400' can be substantially similar. In other examples, the jaw assemblies 400, 400' can be configured differently. Further, more or less than two jaw assemblies 400, 400' can be provided as desired.

As introduced, the jaw assemblies 400, 400' are configured to be moved into gripping contact with a drill rod to reduce or prevent rotation of the drill rod. Preventing or reducing rotation of one drill rod can allow the breaking device 300 to rotate an additional drill rod on an opposing side of a joint between the two drill rods to break the joint. One exemplary breaking device will now be described in more detail.

Figure 3A:
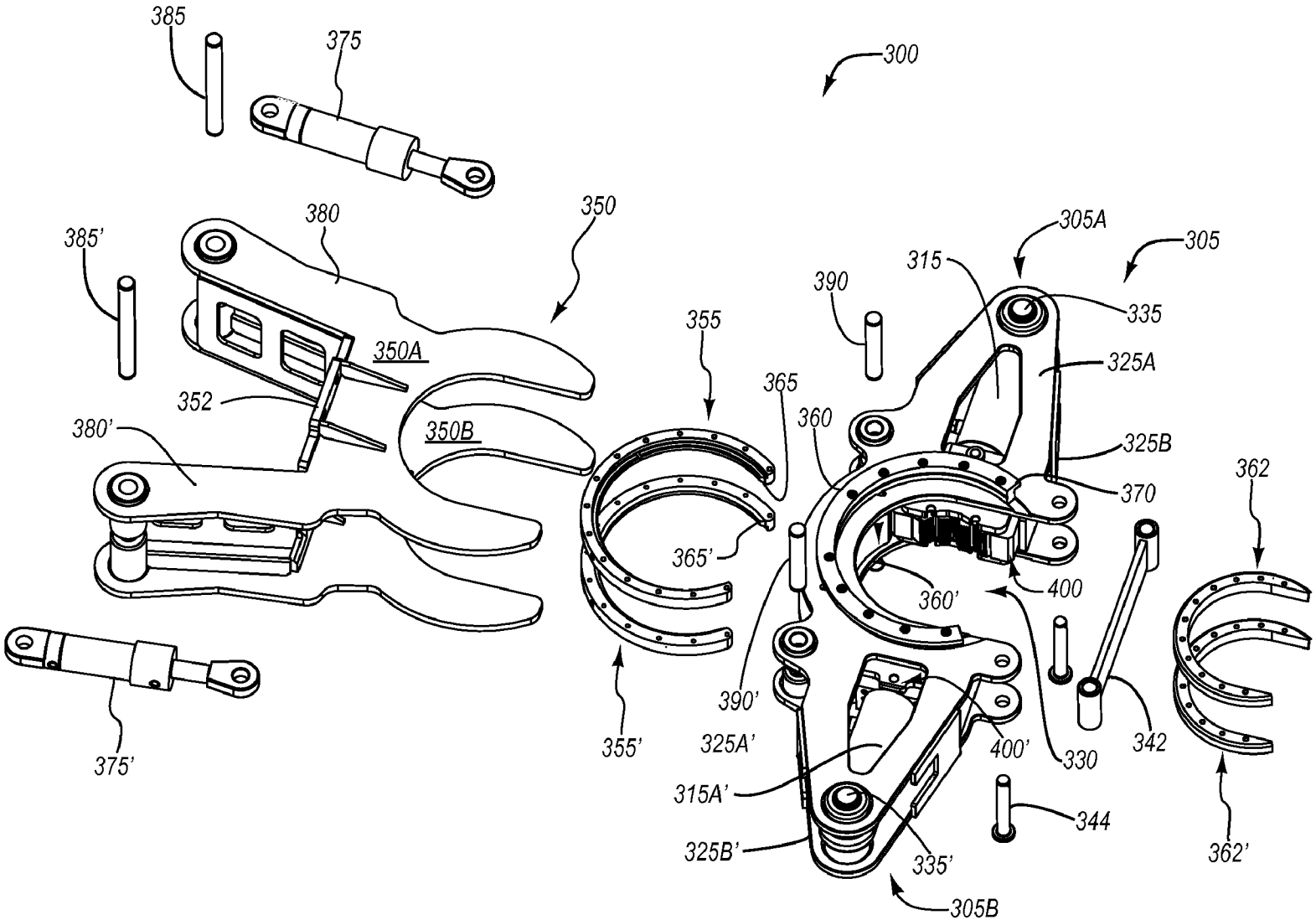
FIG. 3A illustrates an exploded view of a breaking device according to one example.

FIG. 3A illustrates a top view of a breaking device 300 according to one example. The breaking device 300 is configured to clamp a drill rod or other threaded tubular member through actuation of a first set of actuators, such as clamping cylinders, and to break a joint between drill rods or other elongate threaded members through the use of a second set of actuators, such as breaking cylinders.

For example, as illustrated in FIG. 3A the breaking device 300 includes a clamp housing 305 having an upper portion 305A and a lower portion 305B. The upper portion 305A and lower portion 305B are spaced apart by any number of peripheral supports. In at least one example, the upper portion 305A and the lower portion 305B can have substantially similar configurations. In other examples, the upper portion 305A and the lower portion 305B can have different configurations. For ease of reference, an example will be discussed in which the upper portion 305A and the lower portion 305B have substantially similar configurations. Accordingly, the discussion of the upper portion 305A can be applicable to the lower portion 305B.

The clamp housing 305 is configured to support one or more of the components to apply a clamping force to a drill rod, including one actuators, such as clamping cylinders 315, 315'. The clamping cylinders 315, 315' are configured to position one or more jaw assemblies 400, 400'. The jaw assemblies 400 associated with the breaking device 300 can be substantially similar to the jaw assemblies associated with the clamping device 200 or they can be different.

Figure 3B:
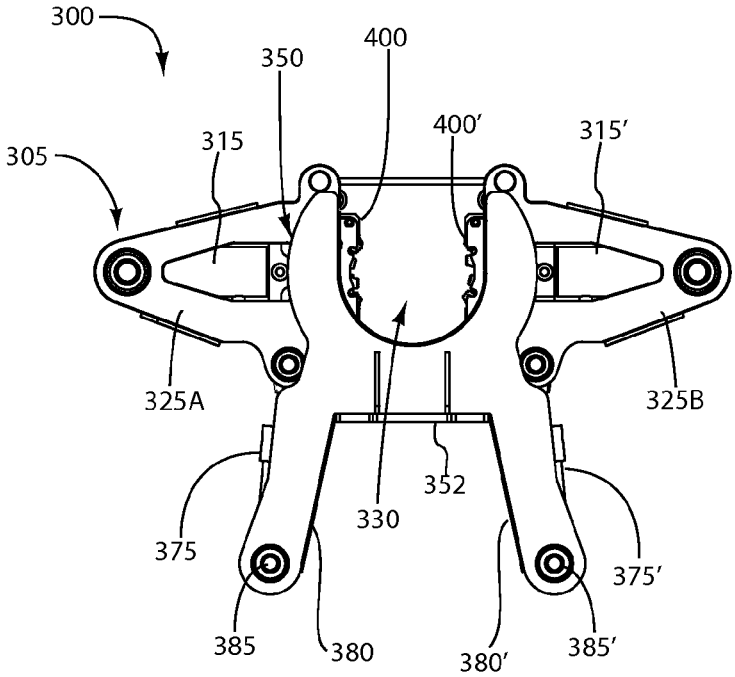
FIG. 3B illustrates a top view of a breaking device according to one example.

In particular, as illustrated in FIG. 3B, the upper portion 305A generally includes opposing arms 325A, 325A'. An opening 330 is defined near a central portion of the housing 305 and extends through the upper portion 305A and the lower portion 305B (FIG. 3B). With continuing reference to FIG. 3B, the opening 330 can be sized to allow drill rods or other elongate threaded members of varying diameters to pass through the clamping device 300.

As illustrated in FIGS. 3A and 3B, the clamping cylinders 315, 315' are secured to the clamp housing 305 by outer pins 335, 335'. In particular, the outer pins 335, 335' can pass through upper portion 305A, through the clamping cylinders 315, 315' and at least partially through the lower portion 305B.

The clamping cylinders 315, 315' can transfer forces to the jaw assemblies 400, 400' in any manner as they extend and retract. In particular, channels can be defined between the upper arms 225A, 225A' and lower arms 225B, 225B that are sized to receive and guide the jaw assemblies 400, 400' when the jaw assemblies 400, 400' are moved by extending and retracting the clamping cylinders 315, 315'. In the illustrated example, extension and retraction of the clamping cylinders 315, 315' moves the jaw assemblies 400 toward and away from the opening 330.

In addition to the clamp housing 305, the breaking device 300 can include a breaking housing 350. The breaking housing 350 can generally include an upper portion 350A and a lower portion 350B that are spaced apart by a base mount 352 as well as any number of additional peripheral supports. The separation between the upper portion 350A and the lower portion 350B (FIG. 3A) allows the breaking housing 350 to receive at least a portion of the clamping housing 305 therein. Further, the clamping housing 305 can be rotatingly coupled to the breaking housing 350 in any manner to allow the breaking housing 350 to rotate the clamping housing 305, which in turn can rotate a drill rod clamped by the jaw assemblies 400, 400'.

As illustrated in FIG. 3A, the clamping housing 305 can be coupled to the breaking housing 350 by one or more interfacing bearing rings. For example, bearing rings 355, 355' can be associated with outer surfaces of the upper portion 305A and the lower portion 305B of the clamp housing 305 respectively. Additional bearing rings 360, 360' can be coupled to inner surfaces of the breaking housing 350. In at least one example, spacers 362, 362' can couple the bearing rings 360, 360' to the upper portion 305A and lower portion 305B respectively. In the illustrated example, the bearing rings 355, 355' can have an arcuate shape as well as rims 365, 365 that are positioned on outer portions of the bearing rings 355, 355'.

Bearing rings 360, 360' can have a shape complimentary to bearing rings 355, 355'. Further, the bearing rings 360, 360' can include rims 370 positioned toward inner portions of the bearing rings 360, 360'. Such a configuration constrains and guides motion of the clamp housing 305 relative to the breaking housing 350 to allow the clamp housing 305 to rotate relative to the break housing 350. In at least one example, bearings or other mechanisms can be employed to reduce friction associated with rotating the clamp housing relative to the breaking housing 350. In other examples, pivots, pins, other rotational devices and/or combinations thereof can be used to allow rotation of the clamp housing 305 relative to the breaking housing 350.

As introduced, the clamping cylinders 315 can be actuated to move the jaw assemblies 400, 400' into engagement with one drill rod on one side of a joint while the clamping device 200 (FIGS. 2A-2B) clamps another drill rod on the other side of the joint. The breaking device 300 can rotate the clamp housing 305 with the jaw assemblies 400, 400' thus engaged to break the joint. The force exerted by the breaking device 300 when it rotates the drill rod can be absorbed by the breaking arms 380, 380', thereby reducing force and/or vibration transmitted to a support structure.

In particular, the breaking device 300 includes at least one actuator, such as breaking cylinders 375, 375'. The breaking cylinders 375, 375' can be coupled to breaking arms 380, 380', which extend away from the base mount 352. The breaking cylinders 375, 375' can be coupled to the breaking arms 380, 380' by pins 385, 385' and to clamp housing 305 by pins 390, 390'. The breaking arms 380, 380' are positioned such as the breaking cylinders 375, 375' extend and retract they exert a force on the clamping housing 305 to thereby cause the clamp housing 305 to rotate relative to the breaking housing 350 about bearing rings 355, 355' and 360, 360'.

In particular, as breaking cylinder 375 extends it exerts a force on arms 325A, 325B to cause the clamp housing 305 to rotate. Similarly, breaking cylinder 375' can retract to draw arms 325A', 325B to rotate the same direction. Reversing the extension and retraction of the breaking cylinders 375, 375 can result in rotation of the clamp housing 305 in the opposite direction relative to the breaking housing 350. Accordingly, the breaking device 300 can clamp and rotate a drill rod in two directions, thereby allowing the breaking device 300 to break both right-hand and left-hand joints by deploying actuators, such as actuators. Further, the breaking device 300 can breaking both right-hand and left-hand joints with similar or the same breaking torque. While actuators discussed above have been described as including hydraulic cylinders, it will be appreciated that any type of actuator can be used. For example, linear actuators can include electrically or other solenoids, chain drive systems, gear drive systems, linear actuators or combinations thereof.

The actuators discussed above have been discussed with reference to jaw assemblies in general. Various types of jaw assemblies can be used to grip and clamp drill rods or other elongate threaded members. Exemplary jaw assemblies will be described below that include multiple gripping contacts that are configured to engage elongate threaded members of varying sizes and shapes. One exemplary jaw assembly 400 is illustrated in more detail in FIGS. 4A-4C.

Figure 4A:
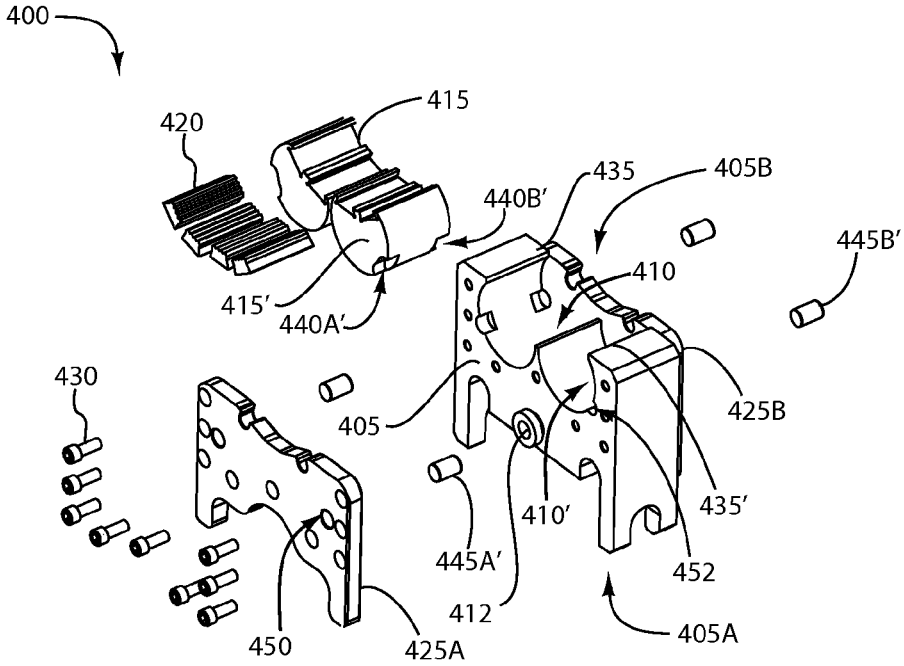
FIG. 4A illustrates a perspective view of a jaw assembly according to one example.

FIG. 4A illustrates an exploded view of a jaw assembly 400. As illustrated in FIG. 4A, the jaw assembly 400 generally includes a jaw body 405 having a first end 405A and a second end 405B. While the jaw body 405 is depicted to be substantially rectangular, it will be appreciated that the jaw body can be any shape including round, square, triangular or any other suitable shape to accomplish its function. For example, the jaw body 405 can be adapted to reduce or eliminate direct contact between the second end 405B of the jaw body 405 and an engaged threaded tubular member. Likewise, the jaw body 405 can be configured so that the jaw can be advanced and retracted smoothly and stably relative to either the housing 205 of the clamping device and/or the clamp housing 305 of the breaking device 300.

As illustrated in FIG. 4A, the jaw body 405 includes insert pockets 410, 410' defined therein. The insert pockets 410, 410' are configured to receive inserts 415, 415'. The insert pockets 410, 410' can be shaped to allow the inserts 415, 415' to rotate therein. In particular, the inserts 415, 415' can have an arcuate outer shape. The insert pockets 410, 410' can have similar shapes or can be configured differently. The inserts 415, 415' are configured to have gripping features, such as tong dies 420 removably coupled thereto. The tong dies 420 associated with each of the inserts 415, 415' can be similar or can be different.

With these round inserts 415, 415' shown, the clamping and breaking devices can securely grip a wide range of pipe (or rod diameters). Generally, the diameters that can be securely gripped range from about 60 mm to about 350 mm. With this latter range of diameters, tong dies 420 incorporated in each of the round inserts 415, 415' are in substantially constant contact with the exterior surface of the tubular member during a drilling operation as shown in FIG. 1A. This arrangement allows more than four friction contacts, such as eight or more friction contacts, during operation whereas conventional jaw designs, on the other hand, typically only provide four frictional contacts. The increased frictional contact can provide better load transmission, thus increasing capacity and safety while decreasing wear on the associated components.

The jaw assembly 400 can further include opposing plates 425A, 425B secured to the jaw body 405. In at least one example, plate 425A can be coupled to the jaw body 405 by one or more fasteners 430. The plates 425A, 425B can be fashioned in such a way that they rarely, if ever, touch a corresponding threaded drill rod directly during operation. Thus, the side plates do not detract from the threading or unthreading action of the jaws. As well, they need not be replaced because they do not wear down from friction with the drill rod.

Plate 425B can be secured to the opposing side of jaw body 405 in any suitable manner, such as by welding. The inserts 415, 415' can be positioned within the insert pockets 410, 410'. The arcuate profile of the insert pockets 410, 410' can include shoulders 435, 435'. The arcuate profile of the insert pockets 410, 410' can allow the inserts 415, 415' to rotate within the insert pockets 410, 410' while the shoulders 435, 435' can retain the inserts 415, 415' within the insert pockets 410, 410' as will be discussed in more detail below.

It will be appreciated that the discussion of insert 415' can be applicable to insert 415 as well. As illustrated in FIG. 4A, insert 415' can include stop channels 440A', 440B' defined therein. The stop channels 440A', 440B' can be configured to engage stops 445A', 445B' that may be passed through openings 450A in the plates 425A, 425B and into engagement one or more stop pocket 452. When the stops 445A, 445B are thus positioned, the stops 445A 445B can also the stop channels 440. As the insert 415' rotates, stops 445A, 445B allow the insert 415' to rotate between engagement with the ends of the stop channels 440A, 440B. Generally, while a wide range of rotation can be accommodated, in some instances rotation can be between about 22.5° to about 45° degrees.

Accordingly, the jaw assembly is configured to allow the inserts 415, 415' to rotate relative to the jaw body 405 while the configuration of the insert pockets 410, 410' helps prevent the insert pockets 410, 410' from inadvertently being dislodged from the jaw body 405. The plates 425A and 425B can further help retain the inserts 415, 415' within the jaw assembly 400. The use of fasteners 430 to secure the plate 425A to the body 405 can allow plate 425 to be removed to provide access to the inserts, such as to replace the inserts, service the inserts 415, 415' or for other purposes.

As mentioned above, the jaw assembly 400 can include a recess 412 defined in the first end 405A. The recess 412 can be formed substantially perpendicular to the first end 405A and substantially parallel to the direction in which the jaw assembly 400 engages the outside surface of the tubular member. The recess can be located substantially along the central line of action of the jaw so that a cross pin hole and the pin 240 (FIG. 2A) can pass through the recess.

The recess 412 is configured to receive a piston bar which is advanced and retracted by means of a clamping cylinder as described above. The piston bar communicates with the recess such that the front surface of the piston bar contacts jaw body 405, thereby driving the jaw assembly during a clamping operation. In this manner, the piston bar drives the jaw assembly directly and not by means of the cross pin 240. Yet when the piston bar is retracted following a clamping operation, the cross pin 240 can help ensure that the jaw assembly 400 is retracted in concert with the piston bar.

Figure 4B:
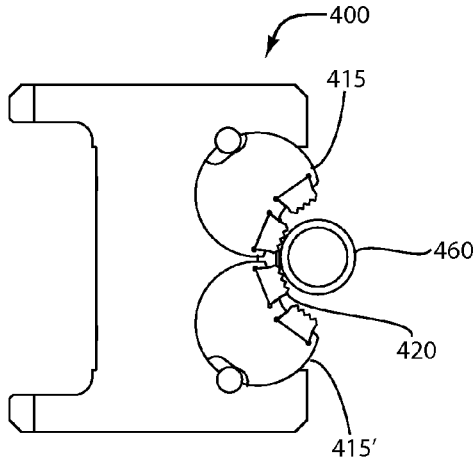
FIG. 4B illustrates a top view of a jaw assembly in which a cover plate has been removed according to one example.
Figure 4C:
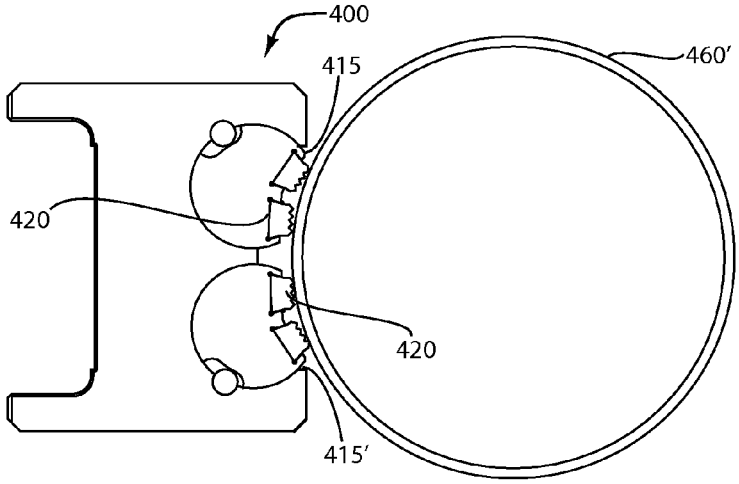
FIG. 4C illustrates a top view of a jaw assembly according to one example.

The jaw body 405 is configured to engage threaded tubular members, such as a drill rod 460 illustrated in FIG. 4B. As the jaw body 405 comes into contact with the drill rod 460, the inserts 415, 415' pivot relative to the jaw body 405 to move the tong dies 420 into contact with the drill rod 460. As illustrated in FIGS. 4B and 4C, the jaw body tong dies 420 can rotate to grip drill rods 460 (FIG. 4B), 460' (FIG. 4C) having a variety of diameters while maximizing the amount of surface area of the tong dies 420 that are in contact with the drill rods. In addition to allowing the jaw body 405 to grip a drill rods with a wide range of diameters, the pivoting inserts 415, 415' to maximize the clamping force the jaw assemblies 400, 400' apply to the drill rods 460, 460'. Further, such a configuration can allow operators to use readily available spare parts.

Figure 5:
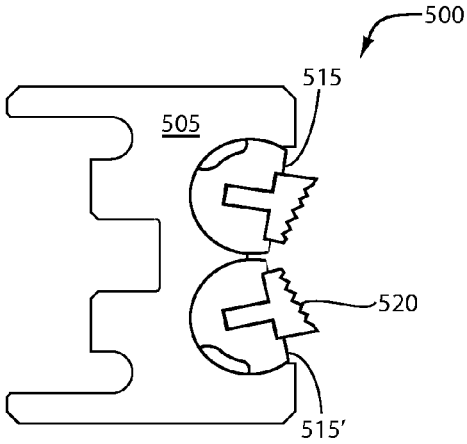
FIG. 5 illustrates a jaw assembly according to one example.

To this point, one configuration of inserts and tong dies has been described. As illustrated in FIG. 5, a jaw assembly 500 can have differently configured inserts 515 and corresponding tong dies interchanged with inserts 515, 515' and tong dies 420. As shown in FIG. 5, the jaw body 505 can be configured to receive round inserts 515 with gripping pads 520. Further, various inserts can be provided with accompanying replaceable pads to accommodate any number of angles or configurations. In this manner, the jaw assembly can be capable of gripping a broad range of threaded tubular member diameters as previously discussed.

Figure 6:
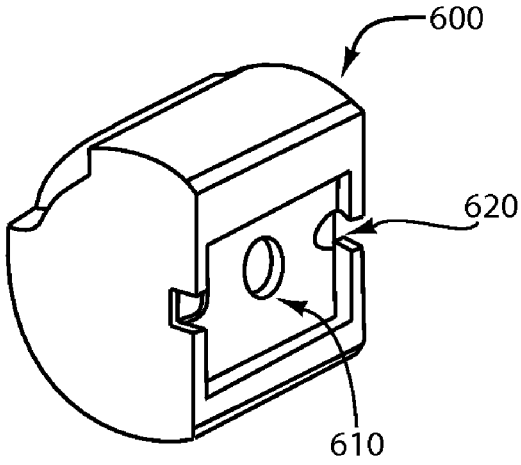
FIG. 6 illustrates a jaw assembly according to one example.

For example, as illustrated in FIG. 6, inserts 600 can contain a groove 610 and cut 620, so that the gripping pads can be easily removed or clipped out and replaced if a different type of pad or a new pad is desired. Further, any type of tong die or gripping pad can be used with inserts including dies and pads that are smooth or incorporate ridges, pads, bumps, teeth and the like to facilitate or alter gripping capacity. Indeed, dies and pads of differing shapes and makes may be used to facilitate or alter gripping capacity.

While the round inserts described above include two slots for the tong dies, in some embodiments the inserts may accommodate one, three, or even more tong dies as needed. Likewise, while the insets depicted above include one gripping pad, the inserts may accommodate one, two, or even more gripping pads. Further, multiple types of round inserts may be used within the jaw assembly beyond the physical depictions shown above.

While tong dies and gripping pads are described, any types of wear insert can be used with any type of inserts. In some instances, tong dies will be used for certain types of inserts because of the size of the drill rods being gripped. In other instances, gripping pads are used because of the size of the drill rods being gripped. The contours of tong dies and gripping pads can be different and, therefore, they can be adapted and used for different purposes.

Figure 7:
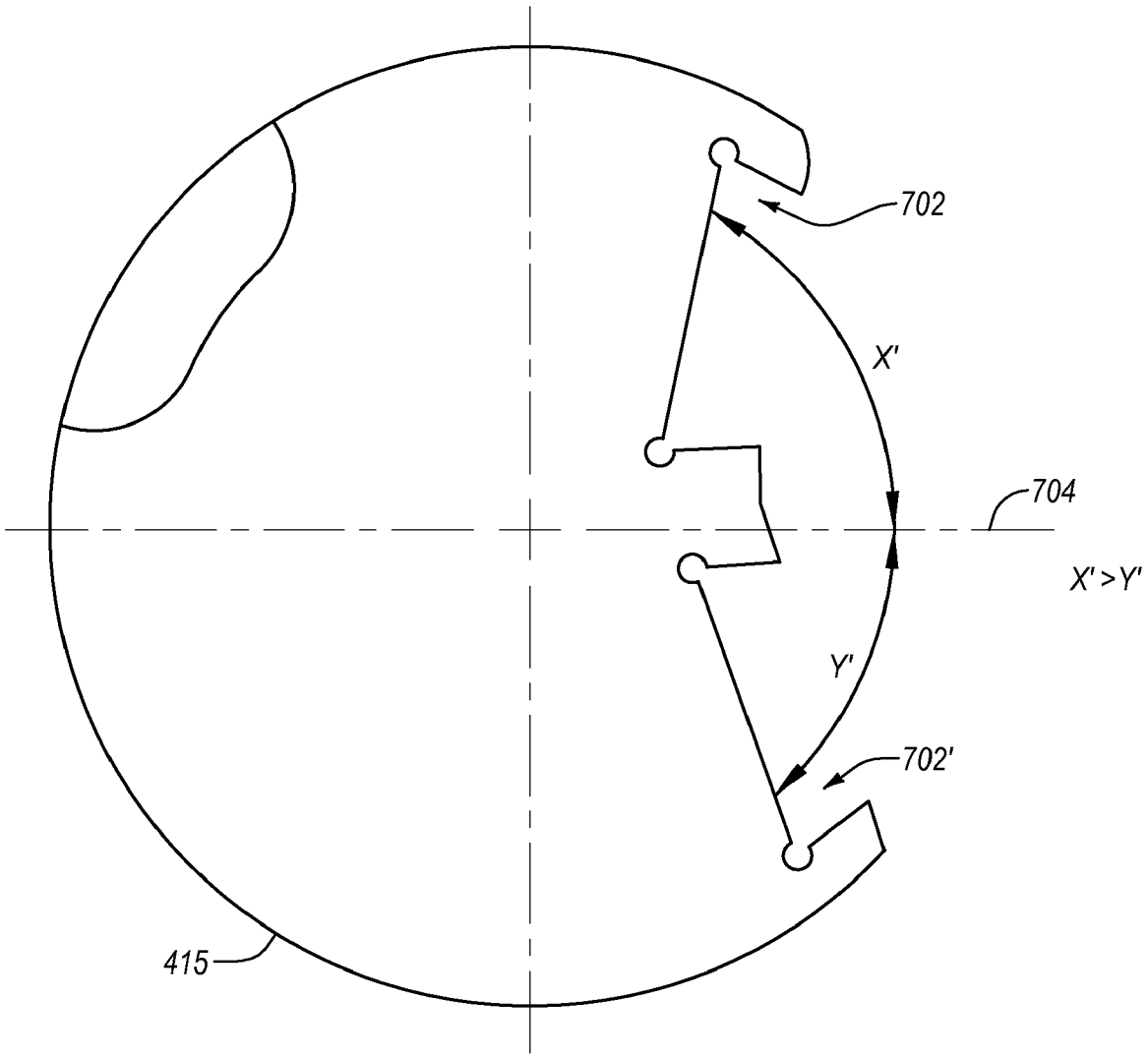
FIG. 7 shows an illustration of a side view of core drill bit with an extended cutting end height Together with the following description, the Figs. demonstrate non-limiting features of exemplary devices and methods. The thickness and configuration of components can be exaggerated in the Figures for clarity. The same reference numerals in different drawings represent similar, though not necessarily identical, elements.

FIG. 7 illustrates a detailed view of the insert 415. As shown, the insert 415' can include multiple slots 702, 702' fashioned to accept the removable gripping features 420 (FIG. 4A). The slots 702, 702' can be fashioned so that the gripping features 420 secured therein have different angles of placement. As depicted in FIG. 7, this arrangement results in asymmetrical alignment of the slots 702, 702' and any gripping features 420 secured therein. For example, FIG. 7 illustrates that a first slot 702 and a second slot 702' have different angles of placement X', Y', with respect to a center line 704 extending through the center of said insert 415 between the first slot 702 and the second slot 702'. In particular the angle of placement X' of the first slot 702 is greater than the angle of placement Y' of the second slot 702'. In this manner, gripping features 420 secured within the slots 702, 702' are capable of gripping a broad range of threaded tubular member diameters as previously discussed.

The clamping device 200, the breaking device 300, and their components can be constructed out of any suitable material(s) that are structurally sufficient to perform their intended functions. Such materials can include but are not limited to steel, aluminum, brass, copper, and other metal alloys Furthermore, the components can be formed out of any or all of these materials by any method known in the art.

The clamping and breaking devices may be used in any desired orientation. For example, the above description typically refers to a vertical orientation so that they are used on a drill rod that is in a vertical position. But the devices could be used for a drill rod that is in a horizontal position. Indeed, the devices could be used with any threaded tubular members that are oriented at any angle.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be encompassed within their scope.

What is claimed is:

1. A jaw assembly, comprising:

a jaw body having a first end and a second end;

at least one insert pocket including an arcuate profile and at least one stop pin positioned along the arcuate profile;

at least one insert positioned within the at least one pocket, the at least one insert having a back end and a front end and including a first slot and a second slot, wherein the back end includes an at least partially arcuate shape complimentary to the arcuate profile of the at least one insert pocket, and wherein the back end includes at least one channel extending into and along the arcuate shape, wherein the at least one stop pin is positioned within the at least one channel;

wherein the at least one insert is configured to rotate within the at least one insert pocket within a range of rotation constrained by the at least one stop pin and the at least one channel;

a shoulder formed on the second end of the jaw body, wherein the shoulder is configured to retain the at least one insert in the at least one insert pocket; and wherein the first slot and the second slot have different angles of placement with respect to a center line extending through the center of the at least one insert between the first slot and the second slot, whereby a first gripping feature in the first slot and a second gripping feature in the second slot have an asymmetrical alignment relative to the center line.

2. The jaw assembly of claim 1, wherein the at least one insert pocket has a partially circular profile.

3. The jaw assembly of claim 1, wherein said first gripping feature is removably coupled to the first slot of the insert.

4. The jaw assembly of claim 1, further comprising a second stop pin positioned along the arcuate profile of the at least one insert pocket, the second stop pin being configured to constrain rotation of the at least one insert relative to the at least one insert pocket.

5. The jaw assembly of claim 4, further comprising a second stop channel extending into and along the arcuate shape of the at least one insert, the second stop channel being configured to cooperate with the second stop pin to constrain the rotation of the at least one insert relative to the at least one insert pocket.

6. The jaw assembly of claim 4, wherein the second stop pin is configured to allow between about 22.5 to about 45 degrees of rotation of the insert relative to the jaw body.

7. The jaw assembly of claim 1, further comprising a plurality of insert pockets defined in the jaw body.

8. A jaw assembly, comprising:

a jaw body having a first end, a second end, a top surface, a bottom surface, a first side, and an opposing second side, said jaw body comprising at least one insert pocket extending into said second end of said jaw body, said at least one insert pocket having an arcuate profile, and a shoulder defined by at least a portion of said second end of said jaw body;

at least one insert having an at least partially arcuate shape complimentary to the arcuate profile of said at least one insert pocket said at least one insert also including a first slot and a second slot, wherein said at least one insert is adapted to rotate within said at least one insert pocket, wherein said shoulder prevents said at least one insert from exiting said at least one insert pocket through said second end of said jaw body;

a first plate secured to said top surface of said jaw body, wherein said first plate prevents said at least one insert from exiting said at least one pocket through said top surface of said jaw body;

a second plate secured to said bottom surface of said jaw body, wherein said second plate prevents said at least one insert from exiting said at least one pocket through said bottom surface of said jaw body; and wherein said first slot and said second slot have different angles of placement with respect to a center line extending through the center of said insert between said first slot and said second slot, whereby a first gripping feature in said first slot and a second gripping feature in said second slot have an asymmetrical alignment relative to the center line.

9. The jaw assembly of claim 8, further comprising a stop in communication with said at least one insert, said stop being configured to constrain rotation of said at least one insert relative to said at least one insert pocket.

10. The jaw assembly of claim 8, wherein said at least one insert pocket comprises a first insert pocket and a second insert pocket.

11. The jaw assembly of claim 10, wherein said at least one insert comprises a first insert and a second insert, wherein said first insert is adapted to be retained in said first insert pocket and said second insert is adapted to be retained in said second insert pocket.

12. The jaw assembly of claim 8, wherein said first gripping feature is adapted to engage a drill string through said opening.

13. The jaw assembly of claim 12, wherein at last a portion of said first gripping feature extends beyond said second end of said jaw body thereby enabling said first gripping feature to engage the drill string without the drill string contacting said jaw body.

14. A jaw assembly for engaging a segment of a drill string for use in a drill string breaking device, the jaw assembly comprising:

a pocket defined by a jaw body;

an insert rotatably positioned within said pocket, said insert adapted to engage a segment of a drill string, said insert including a first slot and a second slot;

a first gripping feature positioned within said first slot of said insert; and a second gripping features positioned within said second slot of said insert;

wherein said first slot and said second slot have different angles of placement with respect to a center line extending through the center of said insert between said first slot and said second slot, whereby said first gripping feature and said second gripping feature have an asymmetrical alignment relative to the center line.

15. The jaw assembly of claim 14, further comprising a second pocket defined by said jaw body, and a second insert position within said second pocket; and a second retaining member coupled to said jaw body.

16. The jaw assembly of claim 15, further comprising a first plate and a second plate.

17. The jaw assembly of claim 16, wherein said first plate is coupled to a first side of said jaw body and said second plate is coupled to a second opposing side of said jaw body.

18. The jaw assembly of claim 14, wherein said first gripping feature comprises a tong die.

19. The jaw assembly of claim 14, wherein said jaw body comprises a shoulder, said shoulder adapted to facilitate retainment of said insert in said pocket.

20. The jaw assembly of claim 14, wherein said first and said second gripping features extend beyond said jaw body thereby enabling said insert to engage the segment of the drill string without the drill string contacting said jaw body.

* * * * *